United States Patent [19]

Gerlach

[11] 4,413,460

[45] Nov. 8, 1983

[54] METHOD OF ASSEMBLING A SPIRAL STAIR CASE

[76] Inventor: Horst Gerlach, Vorhölzerstrasse 17, 8000 München 71, Fed. Rep. of Germany

[21] Appl. No.: 224,574

[22] PCT Filed: Feb. 29, 1980

[86] PCT No.: PCT/DE80/00022

§ 371 Date: Nov. 1, 1980

§ 102(e) Date: Oct. 27, 1980

[87] PCT Pub. No.: WO80/01819

PCT Pub. Date: Sep. 4, 1980

[30] Foreign Application Priority Data

Mar. 1, 1979 [DE] Fed. Rep. of Germany ..... 2907959

[51] Int. Cl.[3] ..... E04F 11/00

[52] U.S. Cl. ..... 52/741; 52/187

[58] Field of Search ..... 52/187, 741; 403/292, 403/306, 362

[56] References Cited

U.S. PATENT DOCUMENTS 2,652,674 9/1953 Lee ..... 403/306 X

FOREIGN PATENT DOCUMENTS 2623484 12/1977 Fed. Rep. of Germany ..... 52/187

*Primary Examiner*—Carl D. Friedman

*Attorney, Agent, or Firm*—W. G. Fasse; D. F. Gould

[57] ABSTRACT

A do-it-yourself spiral staircase has a central column (1) made of a hollow steel tube or pipe, which extends between a support (2; 7; 16) on a lower floor and a landing plate or end tread (3) on an upper floor of a residence or office building. The individual treads (4) are distributed along the column between spacer sleeves (5; 5'). The steel tube or pipe is divided into two tubular sections, of which one tubular section (11; 15; 15'; 20) has an excess length and can be shortened at its free end for adjustment to the required height of the spiral staircase to the size required at the construction site, whereas the other, ready-made tubular section (10; 18) is telescopically attached to the tubular section which has been shortened. At least two mutually aligned or registering bores are provided. Each bore passes radially through its respective telescopically engaging tubular parts. A highly hardened locking pin or split sleeve (14; 14') is driven or pressed into the aligned bores to provide an elastic bias to securely connect both tubular sections with each other at the construction site.

8 Claims, 11 Drawing Figures

METHOD OF ASSEMBLING A SPIRAL STAIR CASE

BACKGROUND OF THE INVENTION

Figure 1A:
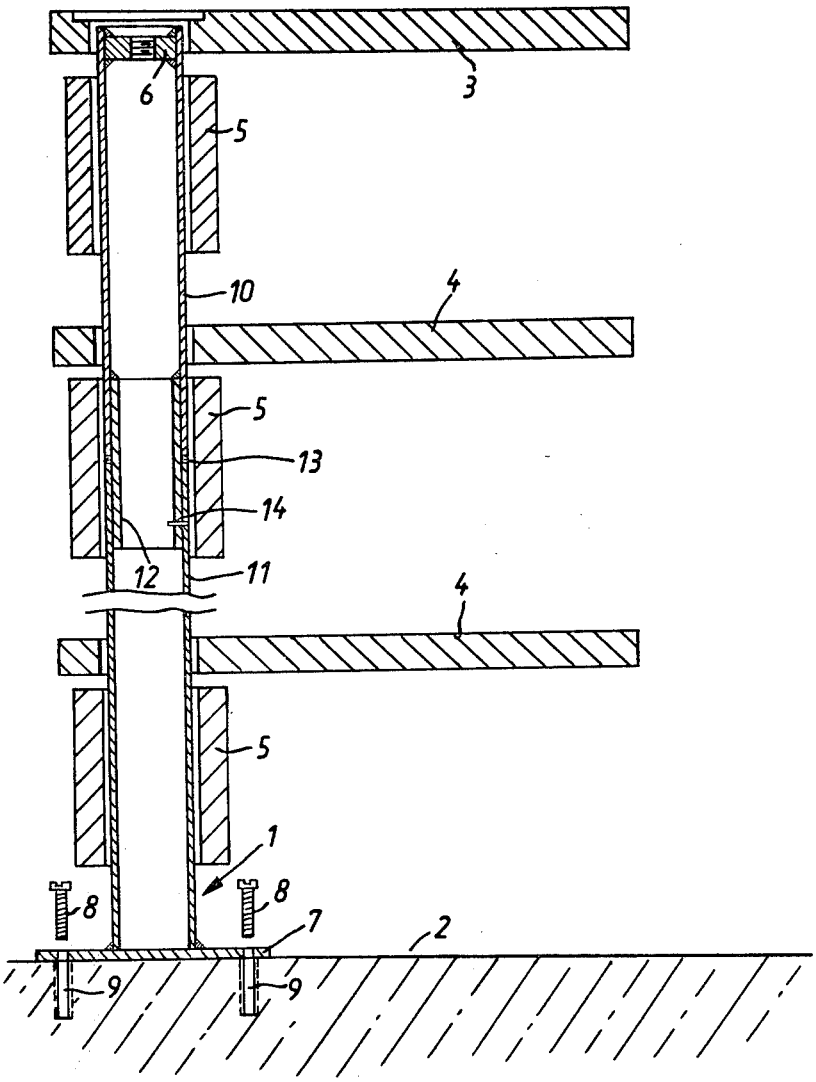

The invention relates to a do-it-yourself spiral staircase with a central column made of a hollow steel tube, which extends between the base support on a lower floor and a landing plate or end tread on an upper floor of a dwelling or office building.

Spiral staircases are known, wherein the central columns are made of an integral steel tube, with a screw nut welded into its head portion. In order to secure the central column to the landing plate or to the upper tread on the upper floor, a clamping bolt engages the nut. At the footing end of the central column is welded a stand or bottom plate which rests on the lower support on the lower floor and is fixedly anchored to the lower floor by bolts or dowels. On the central column are aligned, one above the other, the individual treads, spaced from each other by spacer sleeves. By pre-stressing the central column at the head thereof with respect to the landing plate or the upper tread, the several treads with the spacer sleeves therebetween are simultaneously firmly pressed to each other.

OBJECTS OF THE INVENTION

It is disadvantageous in the known spiral staircase structures, that the central columns must be provided in exactly predetermined lengths depending on the floor spacing. However, since the floor spacings differ substantially from one case to another, the central columns are required in most varying lengths which can be produced only by way of custom-made products. The storage of central columns in all conceivable lengths is uneconomical.

Thus, it is an object of the invention to provide a spiral staircase of the aforesaid type, wherein storage of central columns having one or a few lengths is possible, and wherein the exact adjustment of a given central column to a predetermined length can be effected by simple cutting tools without welding, even at the building site, in a "do-it-yourself" fashion.

SUMMARY OF THE INVENTION

According to the invention, the object has been achieved by dividing the steel tube into two tube sections of which one section can be shortened at its one end to adjust the entire height of the spiral staircase at the construction site, to match the desired size, while the other section is ready-made and is fixedly securable to the first section at the construction site.

A further advantageous embodiment of the invention resides in that the steel tube comprises a pipe section adjacent to the landing plate or end tread, which can be shortened at its free end for adjustment to the total height of the spiral staircase at the construction site, and that a ready-made tubular sleeve is provided, which is fixedly secured to a bottom plate, which telescopically engages the free end of the shortened tube and/or telescopically surrounds the shortened tube.

A still further advantageous embodiment according to the present invention resides in that the steel tube comprises a longer tube section fixedly secured to a bottom plate, and a shorter tube section ready-made for engagement with the landing plate or an end tread, and whereby the free end of the longer tube section may be shortened at the construction site to such a length that both tube sections abut against each other with their free ends to provide the required total height for the spiral staircase, and that at the free end of the shorter tubular section there is provided a tubular sleeve which engages the free end of the longer tube section in a telescopic fashion.

It can be of advantage in all embodiments to insert between the faces of the steel tube sections abutting each other simple annular members from resilient material. Further advantageous embodiments are apparent from further dependent claims.

The base mounting of the two-part central column does not pose any problem since, due to the shortening of a central column portion only at the construction site, an exact adjustment of the required total length, differing from case to case, of the central column assembled from both portions can be done very easily. In particular, the shortening can be effected without difficulties only at the building site. For this purpose, the tube end to be shortened of a central column section is simply to be secured to a gauge and sawed-off. Such work can be effected by mechanics without special knowledge. In order to assure that the shortened cut surface of one of the central column parts can properly fit with a counterface of the other part of the central column, the aforesaid resilient ring can be used.

BRIEF FIGURE DESCRIPTION

Figure 1B:
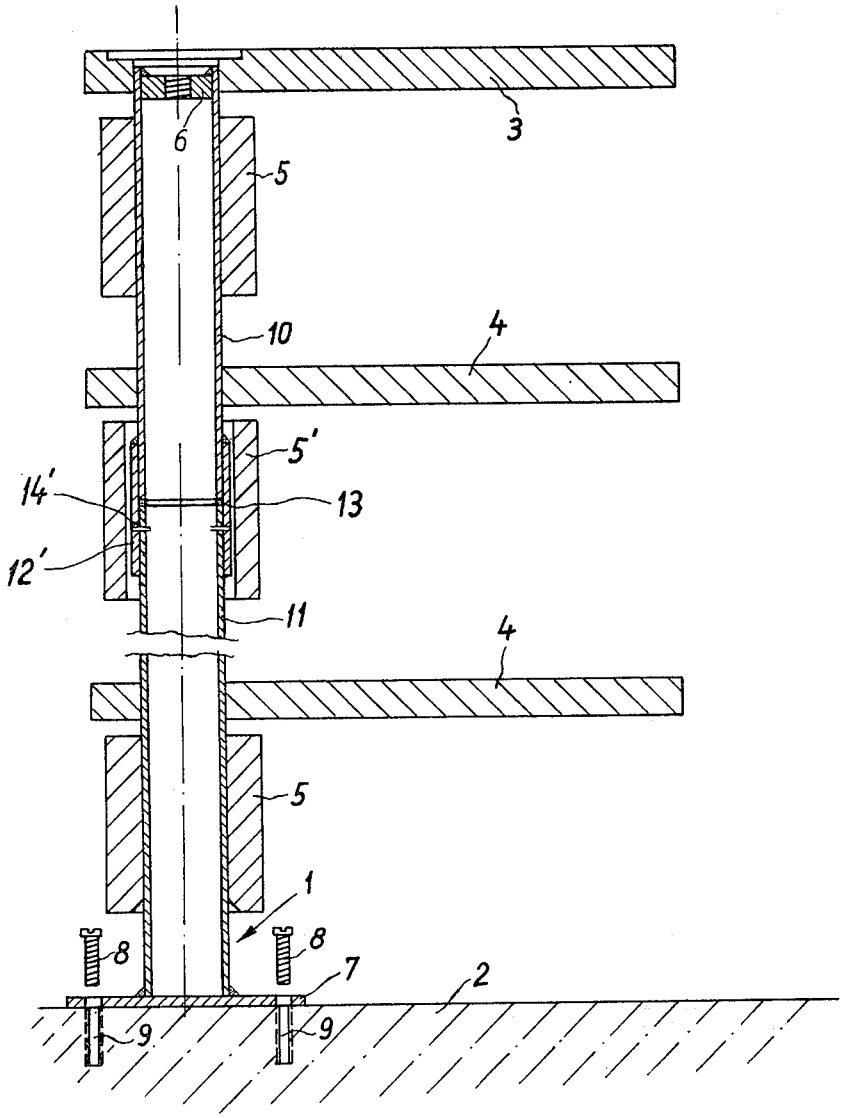
Figure 2A:
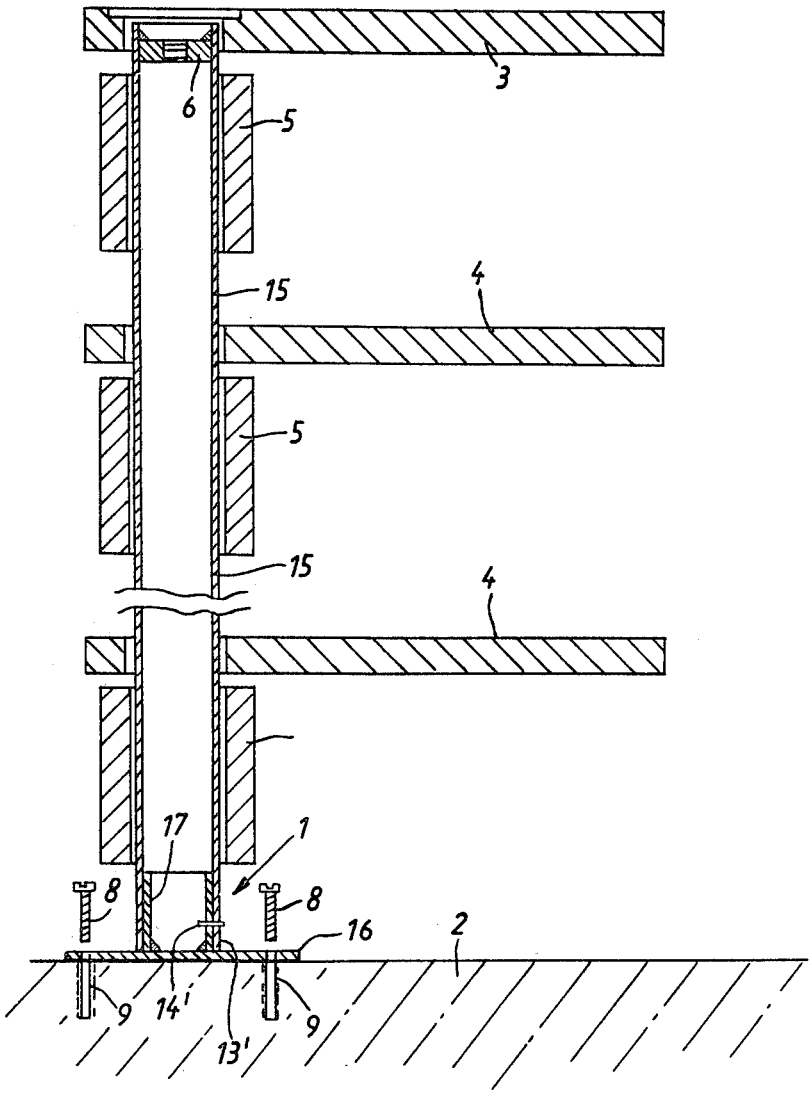
Figure 2B:
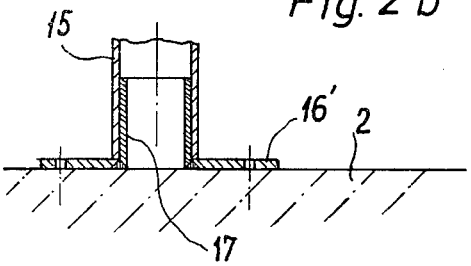
Figure 2C:
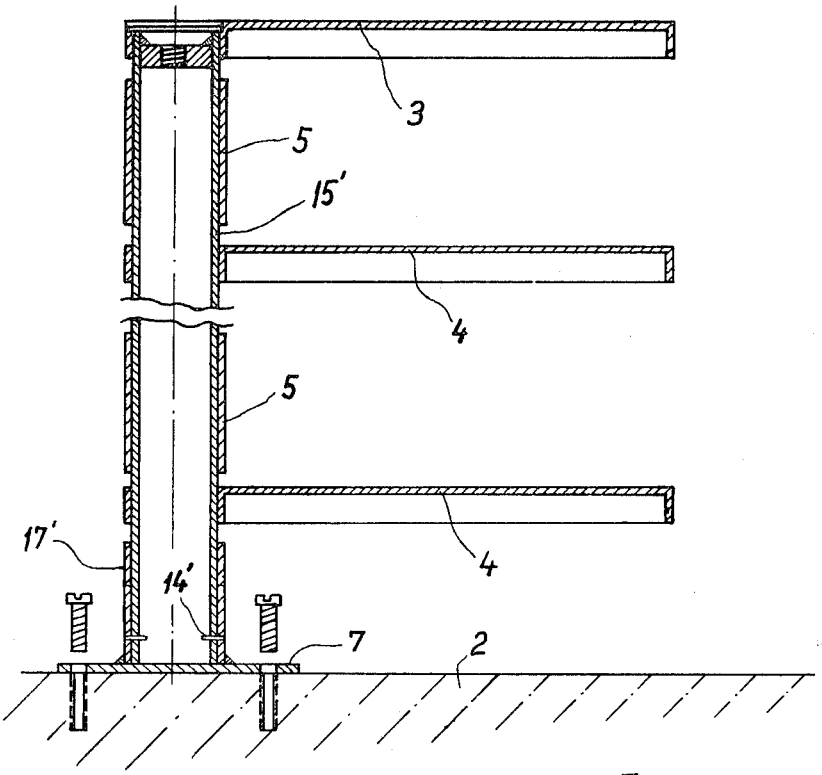
Figure 2D:
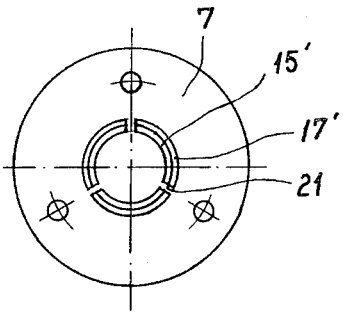
Figure 3A:
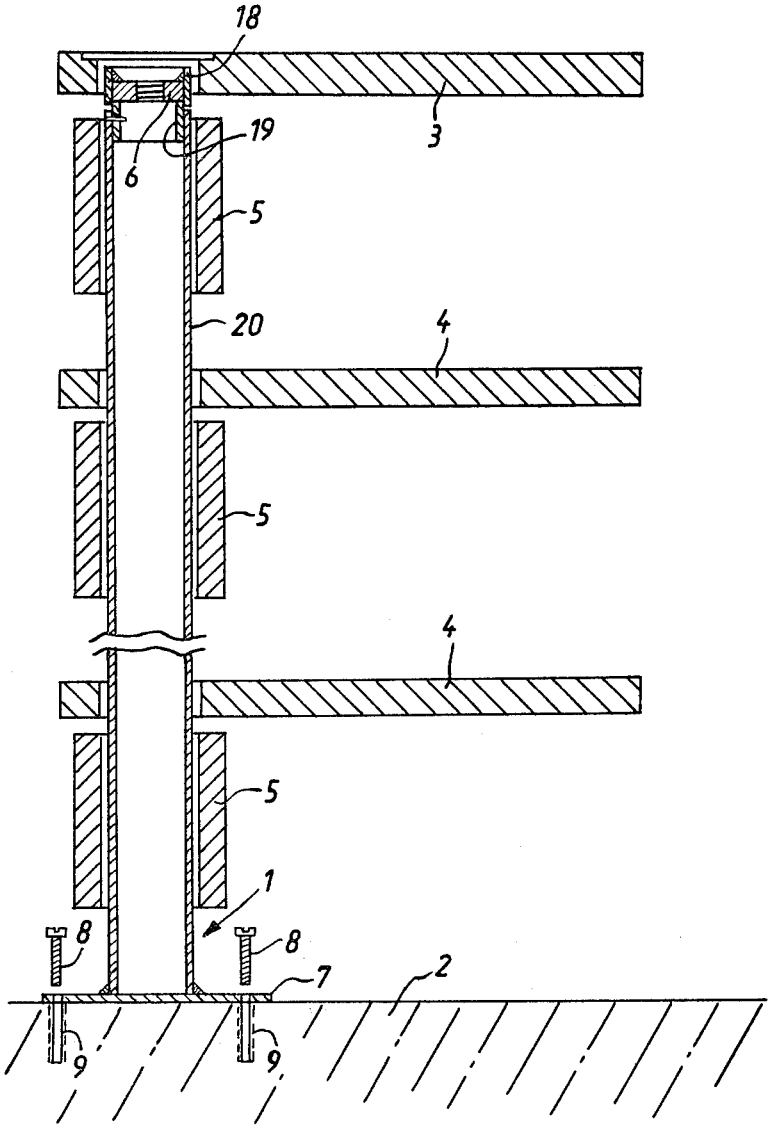
Figure 3B:
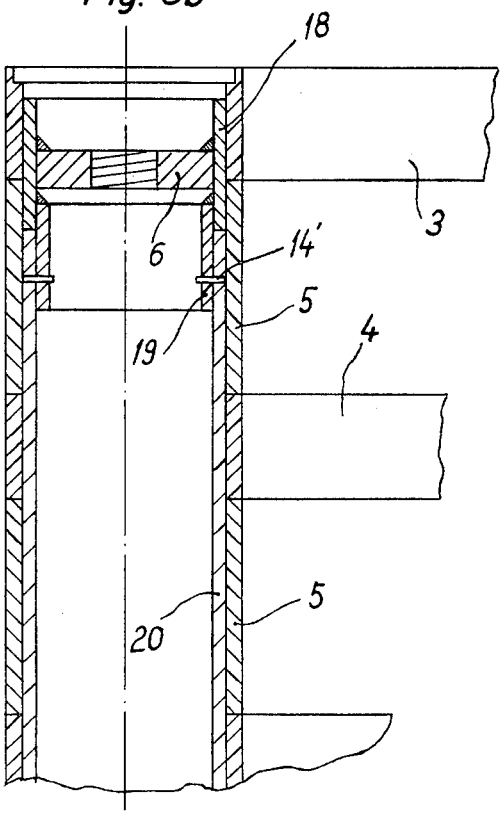
Figure 3C:
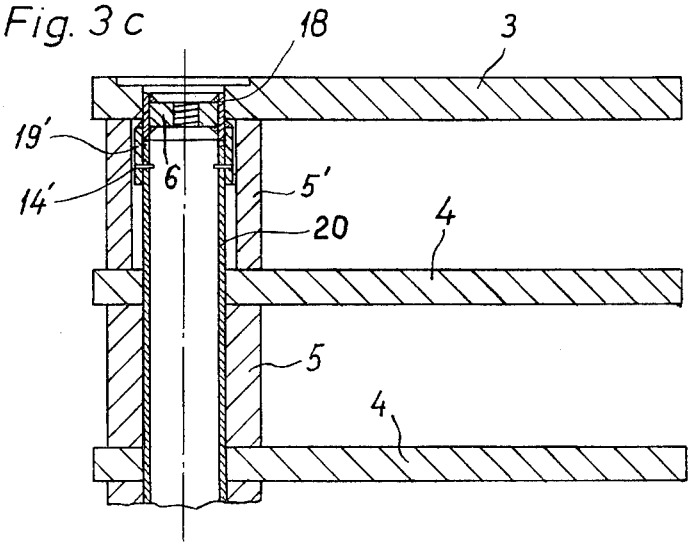

In order that the invention may be clearly understood, it will now be described by way of example, with reference to the accompanying drawings, wherein:

FIGS. 1*a* and 1*b* are longitudinal sections of two preferred embodiments shown in axially exploded and interrupted representations;

FIGS. 2*a* to 2*c* and 2*e* to 2*g* are longitudinal sectional views of a number of further embodiments in cut-off or interrupted as well as partly exploded representations;

FIG. 2*d* is a sectional view of the footing of the central column;

FIGS. 3*a* to 3*c* are longitudinal sections of a number of still further embodiments.

DETAILED DESCRIPTION OF PREFERRED EXAMPLE EMBODIMENTS AND OF THE BEST MODE OF THE INVENTION

In FIG. 1*a*, the tubular central column 1 extends between a lower support 2 on a lower floor and a landing plate 3 or an end tread on an upper floor of a dwelling or office building. Between the landing plate 3 and the lower support 2 there are arranged a number of treads (e.g. fourteen treads). For the sake of simplicity, the drawing shows only two treads 4. The shown interruption of the central column is to be interpreted as meaning that between the landing plate 3 and the lower support 2 are provided more than two treads. The treads 4 are spaced from each other or maintained at a spacing in a known way by spacer sleeves 5. The treads and the spacer sleeves can as here be made from wood or metal. The inside diameter of the sleeves 5 and of the cylindrical passages in the treads are only slightly greater than the outside diameter of the central column, so that the sleeves and the treads can be maintained in an appropriate position along the central column.

A nut 6 is provided at the head end of the central column 1. The nut 6 is welded to the interior of the central column. The central column 1 can be fixedly secured by the nut 6, in a known way, to the landing plate 3. To this end, a bolt, not shown, is engaged in the nut 6 and is provided to press against a stressing device seated on the landing plate.

At the footing end, the central column 1 comprises a round or rectangular bottom or footing plate 7 which is fixedly secured to the central column and which rests on the lower support 2. The footing plate is secured by anchors or bolts 8 which are fixedly engaged in openings 9 for the anchoring of the central column in the lower base 2.

According to the teaching of the present invention, the central column comprises two tubular steel sections 10, 11. At the upper end of the upper tubular steel section 10 is welded the nut 6. In the lower end of the tubular steel section 10 is fixedly secured, e.g. welded, a tubular piece or sleeve 12, whose free end engages telescopically into the lower tubular steel section 11. Welded to the lower end of the lower tubular steel section 11 is a footing plate 7.

The upper tubular steel section 10 with the nut 6 welded in the upper end thereof and with the tubular sleeve 12 secured, e.g. welded, at its lower end, can be produced ready for application, in one or few predetermined lengths for storage. Similarly, the lower tubular steel section 11 can be produced for storage in one or few predetermined lengths. In order to assemble a central column 1 in a predetermined length, the lower tubular steel section 11 can be shortened at its free tubular end by such a degree that, following the abutment of the upper tubular steel section 10 onto the lower tubular steel section 11, both tubular sections 10 and 11 combine to assume the desired total length of the central column 1. The shortening of the lower steel tube section 11 can easily be carried out at the construction site, as it simply has to be fixed in a gauge and then shortened with a saw to a premeasured length. Such work can be effected by mechanics not particularly qualified for building staircases and not possessing any special license as staircase builders.

It can be of advantage to arrange a flat ring 13 from a plastically deformable resilient material, between the abutting faces of the upper and lower steel tube sections 10 and 11, so that the mutually opposite face surfaces of the steel tube sections do not lie directly on top of each other to compensate for uneveness between the faces, whereby a special working of the face surface is not required.

When the lower steel tube section 11 is shortened to a predetermined length and the upper steel tube section 10 is seated on the lower steel tube section 11, the section of the tubular sleeve 12 engaging into the steel tube section 11 is e.g. fixedly secured to the steel tube section 11. It is clear that the invention is not limited to a particular type of securement. One skilled in the art has at his disposal a plurality of equivalent possibilities of securement. To these belong locking pins, split sleeves, metal bolts as well as metal adhesives. In particular, a locking pin or the like 14 can be sufficient, which is driven or pressed into a bore with an elastic bias. The bore, which is only provided at the construction site after the shortening of the steel tube section 11, extends perpendicularly to the walls of the lower steel tube section 11 and the tubular sleeve 12. It is clear that instead of a resilient pin 14, a plurality of expansion springs or the like can be provided, and that the expansion springs can also be substituted by one or more self-tapping screws. The tubular sleeve 12 engages at a small clearance, in telescopic fashion, in the steel tube section 11. When the tubular sleeve 12 is formed as a resilient sleeve adapted to exactly engage clamping surfaces at the inner walls of the lower steel tube section 11, a fixed connection of the tubular sleeve 12 with the steel tube section 11 may be achieved by means of a metal adhesive. In the same fashion, the tubular sleeve 12 can also be riveted to the tubular section 10.

The abutment or joint between the two steel tube sections 10 and 11 can be disposed at any desired location. It can be positioned such that it is disposed in a region of a spacer sleeve between two treads 4. Besides, it is clear that the tubular piece 12 can also be welded to the upper end of the lower steel tube section 11 and that the lower end of the upper steel tube section 10 can be adapted for shortening, whereupon the tubular sleeve 12 would engage the free end of the upper steel tube section 10 and would be arranged for becoming fixedly secured thereto. Locking pins or sleeves 14 are of particular advantage as they do not protrude over the outer surface of the central column 1, so that the treads 4 and the spacer sleeves 5 can engage the central column at a small clearance. If only relatively small differences in height are to be taken into consideration, it can be useful to provide flat steel spacer rings of different thickness, whose inner and outer diameters are approximately equal to the inner and outer diameter of the steel tube sections. The tube sections 10 and 11 can then be provided in even lengths producing a common length which is somewhat smaller than the average floor height. The difference in length between the total length of the tubular sections 10 and 11 and the particular spacing between the floors can then be equalized by one or more spacer steel rings inserted in the place of the plastic ring 13 between the opposite faces of the tube sections 10 and 11. Therefore, the bores are produced into which the locking pins or split sleeves 14 can be inserted.

FIG. 1*b* shows a variant of the spiral staircase according to FIG. 1*a*. Contrary to the embodiment of FIG. 1*a*, the tubular sleeve 12' of FIG. 1*b* is fixedly secured, e.g. welded, to the upper tube section 10 at the exterior thereof and extends somewhat over the lower end of the tube section 10, so that the upper end of the lower tube section 11 can be inserted into the end of the tubular sleeve 12' after adjustment of its length. The tubular sleeve 12' can also be fixedly secured to the tubular section by a locking pin.

The connection of the telescopically inwardly protruding tubular section at the construction site results correspondingly as in the embodiment of FIG. 1*a*, by at least one locking pin or split sleeve 14'. The inner diameter of the spacer sleeve 5' in FIG. 1*b* is somewhat greater than the outer diameter of the tubular sleeve 12' so that it surrounds the tubular sleeve at a small clearance. The remaining spacer sleeves as well as tube passages in the treads have a normal inner diameter, which is only slightly greater than the outer diameter of the two tubular sections. In assembling the spiral staircase, the sequence is that of first cutting the tubular section 11 to its appropriate length, whereupon the bottom plate 7 with the shortened tubular section 11 is anchored to the base 2, then the successive spacer sleeves 5 and treads 4 are placed over the tube section 11 until only a relatively short end portion of the tube section 11 protrudes over a tread 4. Then the tube section 10, with the secured tubular sleeve 12', is fastened over the free upper end of the tubular section 11. The mutually engaged tubular sections are fixedly secured to each other by at least one pin 14'. Thereupon, the special spacer sleeve 5' with a wider inner diameter is placed. The length of this spacer sleeve 5' is greater than the length of the tubular sleeve 12'. The lengths of both tubular sections 10 and 11 must be so chosen in accordance with the invention, that after the shortening of the tubular section 11 in order to adjust the staircase to a predetermined height, it is achieved that the special spacer sleeve 5' overlaps the tubular sleeve 12' at both ends thereof. For this purpose, it is useful when the ratio of the length of the tubular sleeve 12' to the length of the spacer sleeve 5' is as small as possible. As can be appreciated in connection with the preceding reference to FIG. 1*a*, it is also possible to produce the tubular section 11 at a fixed length, if arrangements are made for spacer rings to be placed in the tubular sleeve 12'.

FIGS. 2*a* through 2*g* show further embodiments according to the invention, wherein the corresponding parts of FIGS. 1*a* and 1*b* have same reference numerals.

Contrary to the embodiments according to FIG. 1*a* and 1*b*, the spiral staircase 1 according to FIG. 2*a* comprises a steel tube 15 adjacent to the landing plate 3 or the end tread, and a bottom plate 16 fixedly secured to a tubular sleeve 17 whose free end engages the interior of the lower free end of the steel tube 15. The steel tube 15, which is provided at its upper end with the nut 6 according to FIG. 1*a*, can be shortened at its lower end to any desired length, on site. Thus, for storage purposes the steel tube 15 will be produced in one or few lengths and will be shortened at the construction site to the desired length. The bottom plate 16 can be produced for a plurality of spiral staircases in one or several basic shapes. It can be placed onto the base, whereupon, in assembling the central column, the steel tube 15, which has previously been cut to a predetermined length, is inserted at its lower end onto the tube extension 17 on the foot end and finally secured to the tubular extension 17 by pins, screws or adhesive. The tubular extension 17 can also be formed such that it assumes a press fit relative to the steel tube 15. Between the bottom plate 16 and the face of the steel tube 15 can be provided a ring 13' from plastically deformable resilient material, in order to compensate for uneveness.

In the shown example, the tube extension 17 is connected with the steel tube 15 in accordance with the arrangement of FIG. 1 only by one locking pin 14' or a split sleeve, which is inserted under stress in a bore extending perpendicularly of the wall of the steel tube 15 and the tubular sleeve 17. Instead of a pin, a plurality, for instance 3 pins, may be feasible. If the steel tube 15 safely engages over the tubular sleeve 17, the securement by pins can be omitted.

FIG. 2*b* differs from FIG. 2*a* particularly in that the bottom plate 16' is provided with a cylindrical recess into which a tubular sleeve 17 fits which is welded to the rear surface of the bottom plate 16'.

FIGS. 2*c* through 2*g* differ from the spiral staircase according to FIGS. 2*a* and 2*b* in that the bottom plate 7 is fixedly secured to a tubular sleeve 17' in which the steel tube 15' is engaged at a small spacing. The tubular portions engaging one above the other are fixedly secured to each other in accordance with the embodiment of FIG. 2*a*, by locking pins or split sleeves 14' shown in FIGS. 1*a* and 1*b*. Such connection can be omitted if the steel tube 15' at its outer surface is sufficiently secured to the inside surface of the tubular sleeve 17'.

In FIG. 2*c*, the spacer sleeves 5 and the treads 3, 4 are all made from metal. One sleeve 5 can be connected with each tread 3 or 4. FIG. 2*d* shows a section of the tube 15' and the tubular sleeve 17' with holes 21 for insertion of the locking pin or split sleeve 14'. In the shown example, three holes are provided, equidistantly spaced around the periphery of the tubular sleeve 17'. The tubular sleeve is preferably provided in advance with holes 21. Following the insertion of the steel tube 15', the holes 2' in the steel tube 15 are drilled by a drilling tool at the construction site, whereby the drill is guided in the preliminarily provided holes 21 in the tubular sleeve 17'.

Figure 2E:
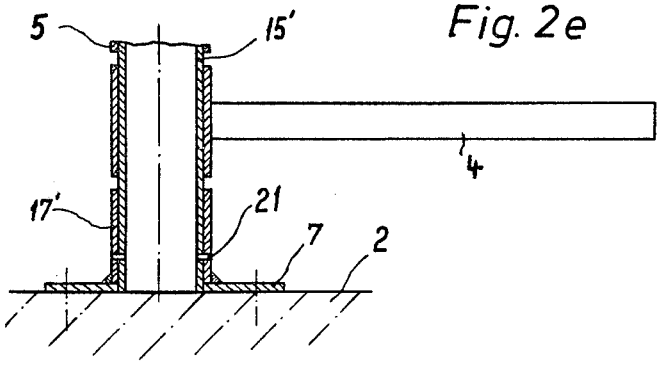

FIG. 2*e* shows a variant wherein the bottom plate 7 is provided with a cylindrical recess as in FIG. 2*b*, wherein the steel tube 15 fits with a small clearance. The tubular sleeve 17' is welded to the bottom plate such that the inner surface of the tubular sleeve is generally flush with the walls of the plate recess. In FIG. 2*c* are shown two mutually opposite bores 21 in section, in which the expansion pins 14' according to FIG. 2*c* are inserted.

Figure 2F:
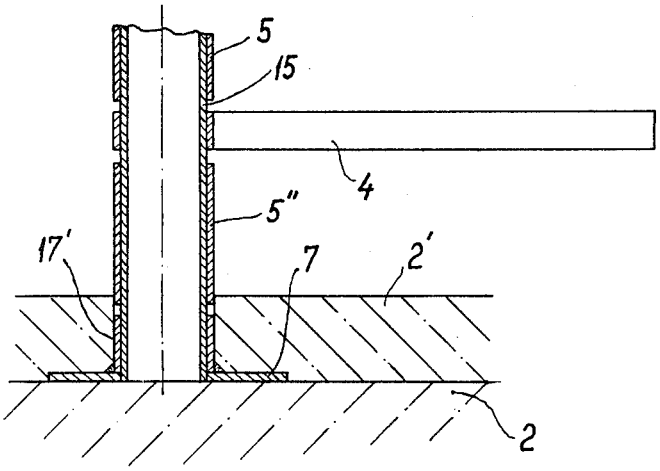

FIG. 2*f* differs from FIG. 2*e* in that the bottom plate 7 is disposed on a concrete base or the like surface. On the concrete base is laid a flooring 2', which is higher than the tubular sleeve 17'. In this case, a special intermediate sleeve 5'' is required, which is followed by the first tread 4.

Figure 2G:
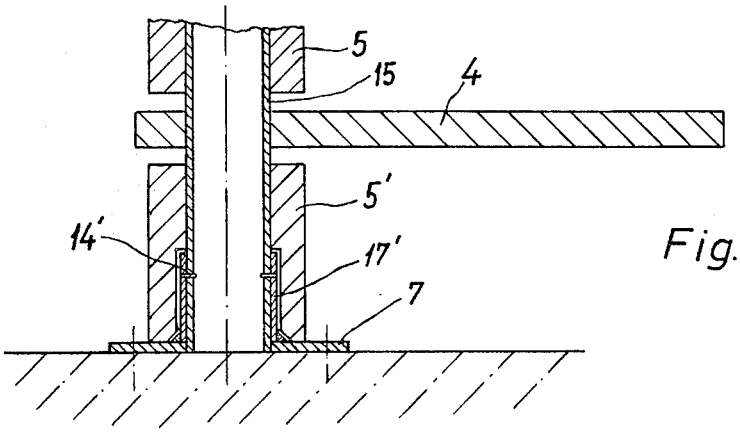

FIG. 2*g* differs from 2*e* in that instead of a thin-walled metal sleeve 5, a thicker-walled sleeve, particularly of wood, is used. In this embodiment, too, a special lowermost sleeve 5' is required, whose interior is provided with a cylindric recess into which the tubular sleeve 17' can engage.

FIGS. 3*a* through 3*c* show each a further variant, wherein the central column 1 comprises a head portion 18 and a steel tube 20 having a bottom plate 7. The ready-made head portion 18 is a short tubular piece with a threaded nut 6 welded therein and serves for connection of the landing plate 4 to the uppermost tread 3. In FIG. 3*a*, the head portion protrudes into a reduced tubular extension 19 which engages into the free end of the steel tube 20, to which is fixedly secured the bottom plate 7 anchored to the base 2 on the lower floor. The free end of the steel tube 20 is arbitrarily reduceable in length to adjust it to the total height of the central column 1. The steel tube can be secured to the tubular extension 19 according to the embodiments previously described, e.g. with locking pins or split sleeves. The embodiment according to FIG. 3*b* corresponds generally to that of FIG. 3*a* with the exception that in FIG. 3*b* the treads 3, 4 and the spacer sleeves 5 are made of metal, while those in FIG. 3*a* are made of wood.

FIG. 3*c* differs from FIGS. 3*a* and 3*b* in that the short tubular piece 19' is welded to the head piece 18 with a nut 16 welded therein, outwardly, as in FIG. 1*b*. The tubular portions engaging one into the other are fixedly secured to each other as in the preceding examples, by means of at least one locking pin 14'. As in the embodiment of FIG. 1*b*, a special spacer sleeve 5' is also required, which can be slid over the tubular piece 19', while all remaining spacer sleeves and the tube receiving passages in the treads are provided with a small clearance relative to the outside diameter of the tube 20. The assembly of the staircase of FIGS. 3*a* to 3*c* is in generally the same as the assembly of the staircase according to FIG. 1*b*.

The invention is not limited to the embodiments described. On the grounds of general knowledge relevant to the present invention, those skilled in the art have readily available further variants for building the new spiral staircase, which fall within the scope of the invention. Thus, the height of the tubular sleeve connected with a bottom plate can be generally the same as the height of a spacer sleeve between two adjacent treads. In accordance with the embodiments described in the foregoing, the tubular sleeve can either be arranged for insertion into the shortened end of a steel tube, or it can be arranged for placement over such end. It is clear that the tubular sleeve can also be built as a double walled sleeve, so that the end of the steel tube engages into a ring nut or slot between the two concentric annular elements disposed at a close spacing from each other, which together form the tubular sleeve. By using a tubular sleeve of the double-wall configuration, the sleeve can be built relatively short, if required, which may be of advantage for the variants according to FIGS. 1*b* and 3*c*.

The spacer sleeves and the tube passages at the rear ends of the treads can also be, for instance, essentially of the same height. It is not absolutely necessary that the height of the sleeves be substantially greater than the height of the treads. Metal treads can be welded to tubular pieces which can protrude to both sides of the respective treads. Incidentally, the treads can have any desired shape. It will further be appreciated by those skilled in the art that the head portion of the central column can be made in a way different from the embodiments shown, without departing from the scope of the invention. Finally, it is not absolutely necessary that the tubular sections according to FIGS. 1*a* or 1*b* be disposed immediately one above the other or that the central column tube according to FIGS. 2*a* through 2*g* be disposed exactly on the bottom plate or the bottom footing when it is connected with the tubular sleeve. The locking pins or split sleeves can further be formed such that the total forces of the spiral staircase are transferred through the central column, the pins or sleeves and the tubular sleeves, into the bottom plate and the base.

Although the invention has been described with reference to specific example embodiments it will be appreciated that it is intended to cover all modifications and equivalents within the scope of the appended claims.

I claim:

1. A method of assembling a spiral staircase to accommodate differences in the height between a lower floor and an upper floor to be interconnected by said spiral staircase having central column means including first support means for securing a lower end of said column means to a lower floor and second support means for securing an upper end of said column means to an upper floor, and treads secured to said column means, comprising the following steps:

(a) providing tubular column means having a total standard length which is longer than said height between floors, (b) providing means for telescoping said tubular column means, (c) making at least one substantially radially extending hole through said telescoping means, (d) cutting off a portion near a free end of said tubular column means so that the remainder of said tubular column means has an axial height corresponding to the height between a lower floor and an upper floor at a particular installation site, (e) telescoping said tubular column means relative to said telescoping means and so that said axial height extends between the floors, (f) making at least one further hole into said tubular column means, thereby using the first made hole as a template for making the further hole so that both holes are aligned with each other at the construction site, (g) driving locking means through said aligned holes at the construction site, and (h) alternately securing spacer sleeves forming rises and horizontal members forming said treads to said central column for completing said spiral staircase at the construction site.

2. The method of claim 1, further comprising providing said tubular column means in the form of two tubular column sections one of which has a standard prefabricated length while the other has an excess length, and wherein said cutting off is performed at the construction site for removing a portion of said excess length to achieve said axial height.

3. The method of claim 2, further comprising inserting a ring of plastically deformable resilient material between said tubular column sections after said cutting-off for compensating for any unevenness between the ends of the tubular column sections.

4. The method of claim 1, further comprising providing said tubular column means as a single tubular column section, securing said telescoping means to said first support means on a lower floor, cutting a free end of said single tubular column section and telescoping said tubular column section relative to said telescoping means.

5. The method of claim 4, further comprising inserting a ring of plastically deformable resilient material between the support means and the end of the single tubular column section remaining after cutting-off.

6. The method of claim 1, further comprising constructing said telescoping means so as to form part of said tubular column means.

7. The method of claim 1, further comprising providing said tubular column means as a single tubular column section, securing said telescoping means to said second support means on an upper floor, cutting a free end of said single tubular column section and telescoping said tubular column section relative to said telescoping means.

8. The method of claim 7, further comprising inserting a ring of plastically deformable resilient material between the support means and the end of the single tubular column section remaining after cutting-off.

* * * * *